US009172184B2

(12) United States Patent
Kamiya

(10) Patent No.: US 9,172,184 B2
(45) Date of Patent: Oct. 27, 2015

(54) LEVER CONNECTOR

(71) Applicant: YAZAKI CORPORATION, Tokyo (JP)

(72) Inventor: Jun Kamiya, Aichi (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 14/379,213

(22) PCT Filed: Feb. 20, 2013

(86) PCT No.: PCT/JP2013/054200

§ 371 (c)(1),
(2) Date: Aug. 15, 2014

(87) PCT Pub. No.: WO2013/125590

PCT Pub. Date: Aug. 29, 2013

(65) Prior Publication Data

US 2015/0043964 A1 Feb. 12, 2015

(30) Foreign Application Priority Data

Feb. 20, 2012 (JP) ..... 2012-034172

(51) Int. Cl.
*H01R 13/629* (2006.01)
*H01R 43/26* (2006.01)

(52) U.S. Cl.
CPC ..... *H01R 13/62938* (2013.01); *H01R 43/26* (2013.01); *H01R 13/62994* (2013.01)

(58) Field of Classification Search
CPC ..... H01R 13/62933; H01R 13/62988; H01R 13/62955
USPC ..... 403/321, 322.4, 353, 349, 350; 439/152, 153, 157, 159, 160
See application file for complete search history.

(56) References Cited

U.S. PATENT DOCUMENTS 5,171,156 A * 12/1992 Nagasaka et al. ..... 439/157
6,254,409 B1 7/2001 Okabe et al.

(Continued)

FOREIGN PATENT DOCUMENTS

JP 4-94279 U 8/1992
JP 6-243927 A 9/1994

(Continued)

OTHER PUBLICATIONS

The English translation of the Written Opinion of the International Search Report for PCT/JP2013/054200 dated May 21, 2013.

(Continued)

*Primary Examiner* — Daniel Wiley
(74) *Attorney, Agent, or Firm* — Kenealy Vaidya LLP

(57) ABSTRACT

A fitting lever (30) includes housing coupling substrates (31) which are coupled to the outside surfaces of a first connector housing (10), cam plates (32) which are coupled to the central parts of the housing coupling substrates (31), and a lever body 33 which is an operating part to pivot the cam plates (32). The cam plates (32) include cam grooves (322*a*, 322*b*) into which the connector housings (10, 20) are fitted with each other with pivoting, and engagement opening grooves (323) which make the cam plates (32) detachable from the connector housings when the cam plates (32) are moved to a pivoting final position N2.

1 Claim, 10 Drawing Sheets

(56) References Cited

U.S. PATENT DOCUMENTS

| | | | |
|---|---|---|---|
| 2002/0142479 | A1 | 10/2002 | Okabe et al. |
| 2012/0297613 | A1 | 11/2012 | Shinkawa et al. |

FOREIGN PATENT DOCUMENTS

| | | | |
|---|---|---|---|
| JP | 9-219248 | A | 8/1997 |
| JP | 2002-298977 | A | 10/2002 |
| JP | 3442661 | B2 | 9/2003 |
| JP | 2011-150934 | A | 8/2011 |
| JP | WO2013125585 | A1 * | 8/2013 |

OTHER PUBLICATIONS

International Search Report and Written Opinion of the International Search Report for PCT/JP2013/054200 dated May 21, 2013.

* cited by examiner

LEVER CONNECTOR

TECHNICAL FIELD

The present invention relates to a lever connector.

BACKGROUND ART

FIG. 15 shows an example of traditional lever connectors.

This lever connector 100 which is disclosed in a PTL1 below includes a first connector housing 110, a second connector housing 120 which is fitted and connected with the first connector housing 110, and a fitting lever 130 which is pivotably installed to the first connector housing 110.

The second connector housing 120 has an outer sheath wall part (hood part) 121 into which the first connector housing 110 is inserted.

The fitting lever 130 is a member by which an operating force to fit/detach the first connector housing 110 into/from the second connector housing 120 can be reduced, and is pivotably installed to shafts 111 which are protruded from the outer side surfaces of the first connector housing 110.

As shown in the figure, the fitting lever 130 includes a pair of lever bodies 131 which are arranged to be opposite to each other so that a pair of outer side surfaces of the first connector housing 110 are sandwiched, a joint member 132 that connects the pair of lever bodies 131 at one end side, pivot fulcrum holes 133 which are formed in the lever bodies 131 and are pivotably engaged with the shafts 111 on the outer side surfaces of the first connector housing 110, and action point protruding parts 134 which are engaged with lever retaining holes 122 which are formed at the outer side surfaces of the outer sheath wall part 121 when a fitting operation begins after the first connector housing 110 and the second connector housing 120 are aligned to a fitting start position.

In the illustrated example, the joint member 132 also serves as a force point part which receives the operating force when the lever bodies 131 are pivoted around the shafts 111.

For the lever connector 100 of the PTL1, the first connector housing 110 is fitted and connected with the second connector housing 120 with the following steps.

First, as shown in the figure, the fitting operation lever 130 is pivotably attached to the first connector housing 110. Then, as shown by an arrow X1 in FIG. 15, the front end of the first connector housing 110 is inserted into the outer sheath wall part 121 of the second connector housing 120, the first connector housing 110 and the second connector housing 120 are aligned to the fitting start position, and the action point protruding parts 134 of the fitting lever 130 are engaged with the lever retaining holes 122 of the second connector housing 120.

Then, the joint member 132 of the fitting lever 130 is pressed down, and as shown by the arrow R1 in FIG. 15, the fitting lever 130 is pivoted. The second connector housing 120 is drawn toward the first connector housing 110 with the pivoting movement of the fitting-operation lever 130, and the fitting of the connector housings with each other is completed.

When the connector housings fitted with each other are to be detached, the joint member 132 is pivoted in a direction opposite to the direction shown by the arrow R1 in FIG. 15 so that the connector housings are detached from each other.

SUMMARY OF INVENTION

Technical Problem

However, in the case of the lever connector 100 of the PTL1, the fitting lever 130 cannot be removed from the first connector housing 110 when the connector housings are fitted with each other.

Therefore, in the case of the lever connector 100 of the PTL1, even when the connector housings are actually used after the connector housings have been fitted and connected with each other, the weight of the fitting lever 130 is added so that the weight of the connector is increased.

In the case of the lever connector 100 of the PTL1, the lever connector 100 must be accompanied by the fitting lever 130, and there is a problem which is that the cost is increased because of the increase of the component number.

The object of the present invention is to solve the above problems and provide a lever connector which makes it possible to reduce the cost due to the reduction of the component number and reduce the weight in a use state.

Solution to Problems

The above-mentioned object of the present invention is achieved by the following construction.

(1) According to an aspect of the invention, a lever connector includes a first connector housing, a second connector housing which is fitted and connected with the first connector housing, and a fitting lever which is pivotably installed to the first connector housing as a lever member to reduce the operating force to fit and detach the first connector housing with and from the second connector housing. The first connector housing includes an outer sheath wall part into which the second connector housing is inserted, lever guiding parts which position the fitting lever to be movable in the fitting direction of the connector housings, first action receiving shafts which are protruded outward from a pair of outside surfaces, respectively, and shaft insertion cuts which are formed by cutting a pair of opposed outside walls of the outer sheath wall part to extend into a straight shape along the fitting direction of the connector housings toward the first action receiving shafts from opening edges of the outer sheath wall part. The second connector housing includes second action receiving shafts which are protruded from the outside surfaces of the second connector housing so that when the connector housings are aligned at a fitting start position, the central axis of the second action receiving shafts is in parallel with that of the first action receiving shafts and the second action receiving shafts confront the first action receiving shafts in the fitting direction of the connector housings, and which are inserted through the shaft insertion cuts to approach the first action receiving shafts when the connector housings are to be fitted. The fitting lever includes a pair of housing coupling substrates which are engaged with the lever guiding parts to be coupled to the outside surfaces of the first connector housing to be insertable and detachable in the fitting direction of the connector housings, a pair of cam plates which are coupled to the central parts of the housing coupling substrates to be pivotable in a predetermined pivoting angle range from a pivoting initial position to a pivoting final position, and a lever body which is fixed to the cam plates and is an operating part when the cam plates are pivoted from the pivoting initial position to the pivoting final position. The cam plates includes a pair of initial engaging parts which are formed to open to outer edges that are opposed in the fitting direction of the connector housings while the cam plates are at the pivoting initial position, and which engage the first action receiving shafts and the second action receiving shafts when the first connector housing and the second connector housing are aligned at the fitting start position, a pair cam grooves which are formed to extend along the circumferential direction from the pair of initial engaging parts and whose final ends, where the action receiving shafts are respectively located when the cam plates arrive at the pivoting final position while the action receiving shafts in the pair of initial engaging parts are respectively drawn toward the pivoting center of the cam plates with the pivoting of the cam plates, confront in the fitting direction of the connector housings, and engagement opening grooves which are formed into straight shapes that pass through the final ends of the pair of cam grooves and open at one end edges of the cam plates, and which make it possible to detach the action receiving shafts to the outside of the cam plates by straightly move the cam plates to a side reverse to the openings along the fitting direction of the connector housings while the cam plates are located at the pivoting final position.

According to the construction of the above (1), first, the fitting lever is inserted to the first connector housing along the fitting direction of the connector housings while the cam plates are located at the pivoting initial position N1. Then, the housing coupling substrates of the fitting lever engage with the lever guiding parts of the first connector housing, and the fitting lever is installed to the first connector housing. At this time, the first action receiving shafts of the first connector housing engage with the initial engaging parts which the cam plates of the fitting lever are equipped with.

Then, while the fitting lever is installed to the first connector housing, the first connector housing and the second connector housing are aligned at the fitting start position. Then, the second action receiving shafts of the second connector housing engage with the initial engaging parts which the cam plates of the fitting lever are equipped with.

Then, while the first connector housing and the second connector housing are aligned at the fitting start position, the lever body of the fitting lever is pivoted to make the cam plates in the fitting lever pivot from the pivoting initial position to the pivoting final position. With the pivoting of the cam plates at this time, the pair of cam grooves on the cam plates draw the action receiving shafts, which are respectively located at the initial engaging parts, toward the pivoting center of the cam plates. At this time, when the action receiving shafts are drawn toward the pivoting center of the cam plates, respectively, the connector housings move in a direction to deepen the fitting with each other. When the cam plates arrive at the pivoting final position, the action receiving shafts arrive at the final ends of the pair of cam grooves, and while the connector housings move toward the pivoting center of the cam plates to the maximum, the connector housings have been fitted and connected with each other.

While the connector housings have been fitted and connected with each other with the pivoting operation of the fitting lever, the action receiving shafts, which are respectively located at the final ends of the pair of cam grooves, face the engagement opening grooves that extend into a straight shape along the fitting direction of the connector housings. Therefore, in this state, because when the fitting lever is pulled up in a direction reverse to the fitting direction of the connector housings, the action receiving shafts respectively exit from the cam plates through the engagement opening grooves, the fitting lever can be detached from the connector housings.

When the fitting lever is to be installed again to the connector housings which are fitted and connected with each other, the fitting lever may be inserted and installed to the connector housings while the cam plates in the fitting lever are located at the pivoting final position. If the connector housings are to be detached from each other, the fitting lever may return the cam plates to the pivoting initial position with the pivoting of the lever body. When the cam plates are returned to the pivoting initial position, with the pivoting of the cam plates, the action receiving shafts, which are respectively located at the final ends of the cam grooves, are moved in a direction away from the pivoting center of the cam plates by the cam grooves, and the connector housings are detached from each other.

That is, according to the construction of the above (1), since after the connector housings have been fitted and connected with each other, the fitting lever is detached from the connector housings, a reduction in weight can be realized in an use state of the connector.

The detached fitting lever can be used in fitting other lever connectors. Therefore, the component set of a regular lever connector only includes the first connector housing and the second connector housing but does not include the fitting lever, so that the cost can be reduced due to the reduction of the component number.

For the construction of the above (1), by drawing the connector housings toward the pivoting center of the cam plates with the pair of cam grooves which the cam plates are provided with to sandwich the pivoting center, the cam plates make the connector housings to be fitted with each other. Therefore, both sides that sandwich the pivoting center of the cam plates are effectively used for the movement of the connector housings. Therefore, in comparison with that only one connector housing is moved in the fitting direction in one cam groove, the cam plates can be downsized and the fitting lever can be downsized by the reduction of the pivoting range of the cam plates.

Advantageous Effects of Invention

According to the lever connector of the present invention, after the connector housings have been fitted with each other, the fitting lever is detached from the connector housings so that a reduction in weight can be realized in an use state of the connector.

The detached fitting lever can be used in fitting other lever connectors. Therefore, the component set of a regular lever connector only includes the first connector housing and the second connector housing but does not include the fitting lever, so that the cost can be reduced due to the reduction of the component number.

The present invention has been briefly described above. Further, details of the present invention will become more apparent after embodiments of the invention described below (hereinafter referred to as "embodiments") are read with reference to the accompanying figures.

BRIEF DESCRIPTION OF DRAWINGS

FIG. 4 is a perspective view which indicates the construction of a pair of coupling substrates which the fitting lever shown in FIG. 1 is equipped with.

DESCRIPTION OF EMBODIMENTS

A preferred embodiment of the lever connector according to the present invention is described in detail with reference to the figures as follows.

Figure 1:
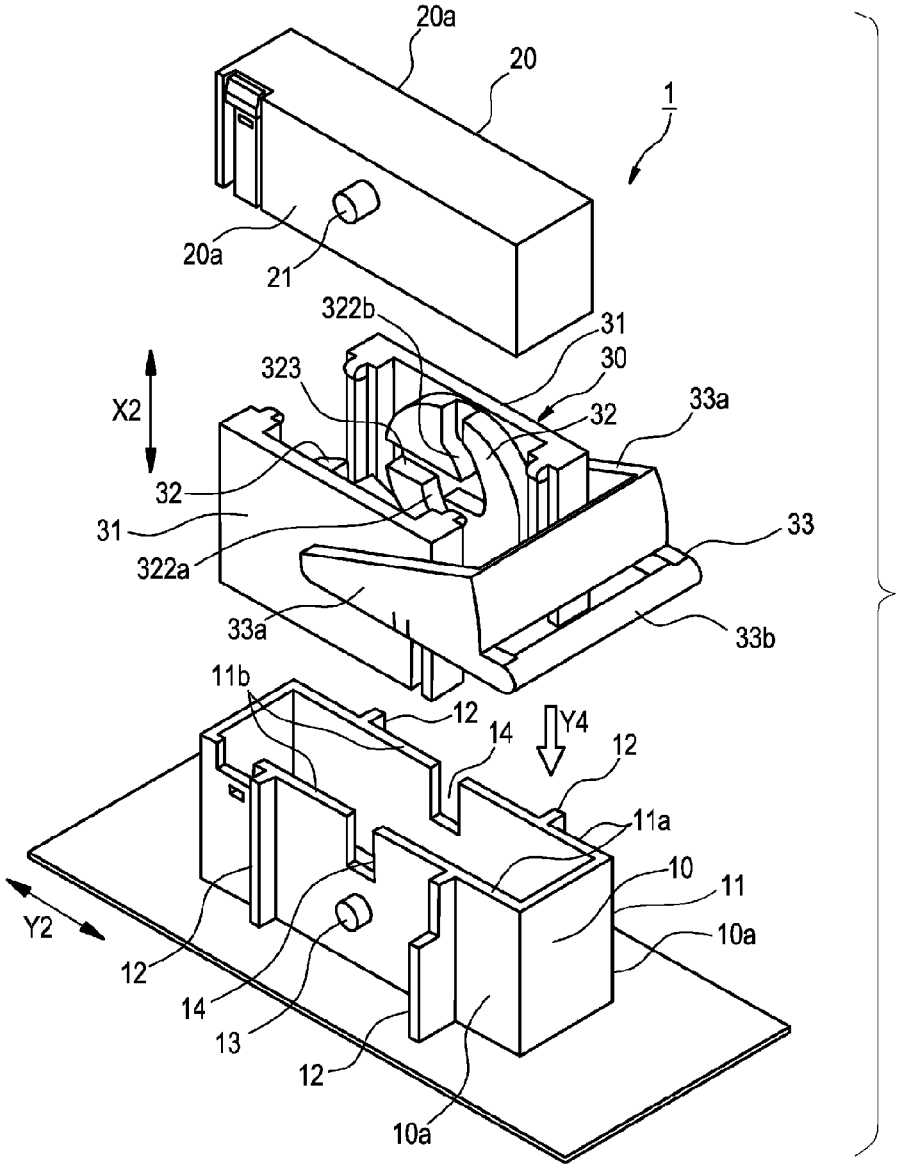
FIG. 1 is an exploded perspective view of a lever connector according to one embodiment of the present invention.
Figure 2:
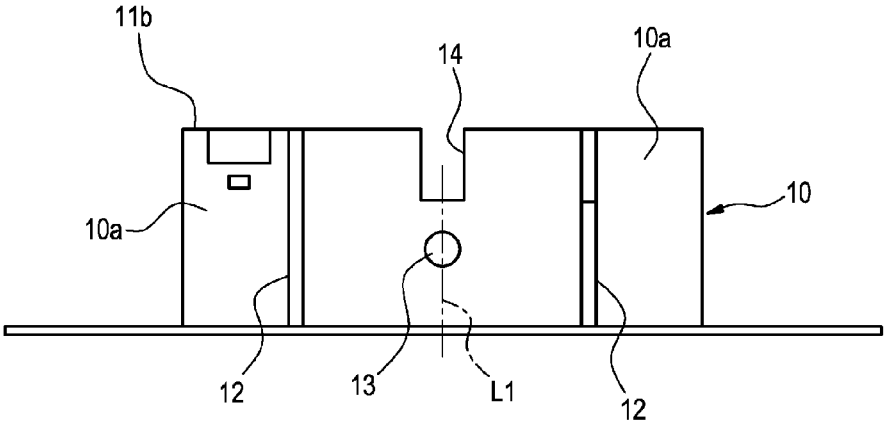
FIG. 2 is a side view of a first connector housing shown in FIG. 1.
Figure 3:
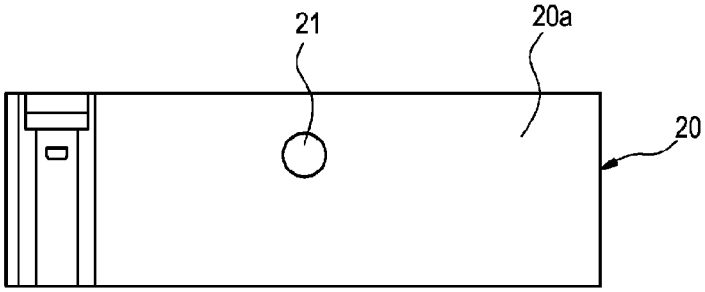
FIG. 3 is a side view of a second connector housing shown in FIG. 1.
Figure 4:
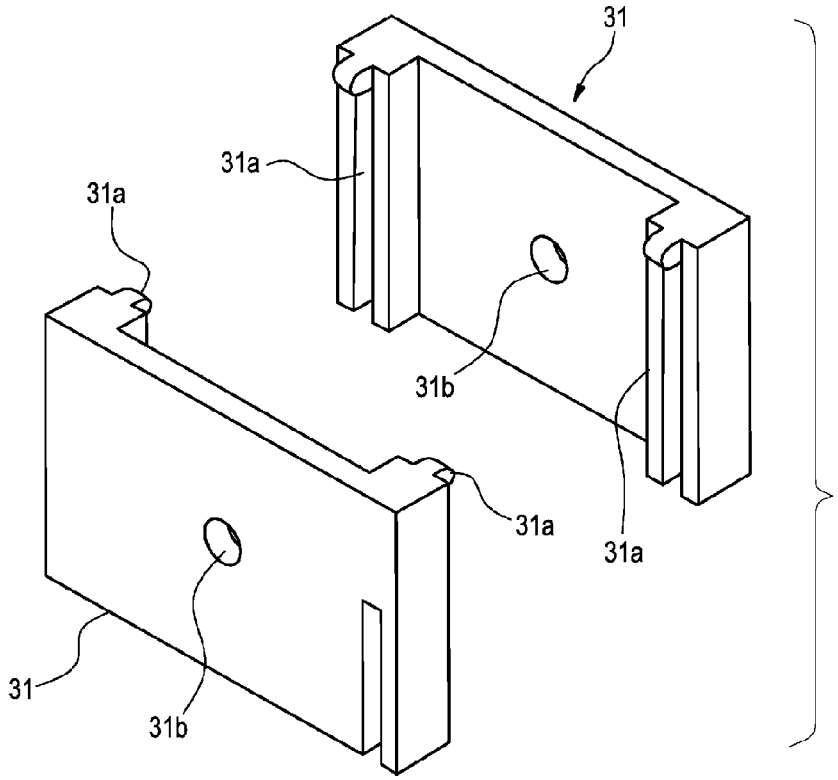
Figure 5:
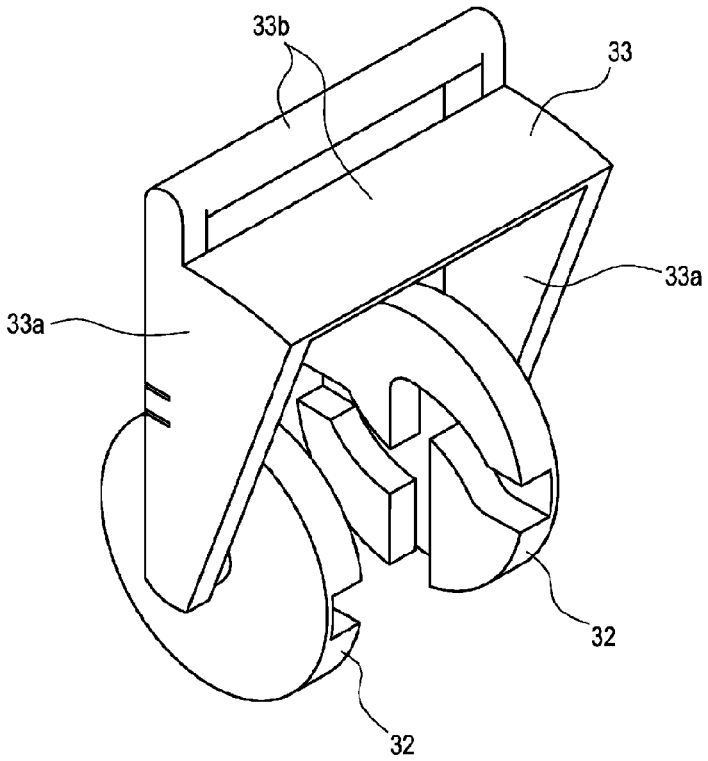
FIG. 5 is perspective view which indicates the relation of cam plates and a lever body of the fitting lever shown in FIG. 1.
Figure 6:
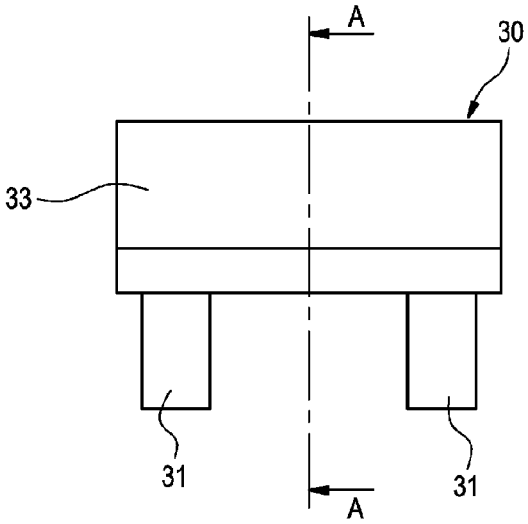
FIG. 6 is a front view of the fitting lever shown in FIG. 1 in which the cam plates are temporarily fixed to a pivoting initial position.
Figure 7:
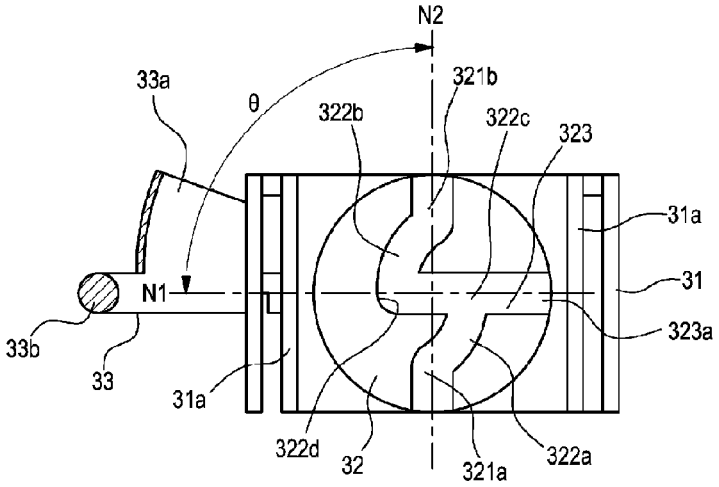
FIG. 7 is an A-A sectional view of FIG. 6.

FIGS. 1 to 5 show a lever connector according to one embodiment of the present invention. FIG. 1 is an exploded perspective view of the lever connector of the embodiment of the present invention. FIG. 2 is a side view of a first connector housing shown in FIG. 1. FIG. 3 is a side view of a second connector housing shown in FIG. 1. FIG. 4 is a perspective view which indicates the construction of a pair of coupling substrates which the fitting lever shown in FIG. 1 is equipped with. FIG. 5 is perspective view which indicates the relation of cam plates and a lever body of the fitting lever shown in FIG. 1. FIG. 6 is a front view of the fitting lever shown in FIG. 1 in which the cam plates are temporarily fixed to a pivoting initial position. FIG. 7 is an A-A sectional view of FIG. 6.

As shown in FIG. 1, a lever connector 1 of the present embodiment includes a first connector housing 10, a second connector housing 20 which is fitted and connected with the first connector housing 10, and a fitting lever 30 which is pivotably installed to the first connector housing 10.

The first connector housing 10 includes a rectangular pipe-like outer sheath wall part (hood part) 11 into which the second connector housing 20 is inserted, lever guiding parts 12 which position the fitting lever 30 to be movable in the fitting direction of the connector housings (arrow X2 direction of FIG. 1), first action receiving shafts 13 which are protruded outward from a pair of outside surfaces 10*a*, respectively, and shaft insertion cuts 14 which are formed by cutting a pair of opposed outside walls 11*a* of the outer sheath wall part 11.

As shown in FIGS. 1 and 2, the lever guiding parts 12 are ribs that extend along the fitting direction of the connector housings. In the present embodiment, the lever guiding parts 12 are protruded from the pair of outside surfaces 10*a* of the first connector housing 10. In the present embodiment, the outside surfaces 10*a* are the outer surfaces of the pair of outside walls 11*a* of the outer sheath wall part 11. The lever guiding parts 12 are provided at two places spaced in the widthwise direction (arrow Y2 direction of FIG. 1) of the connector on the outside surfaces 10*a*.

The first action receiving shafts 13 are shafts (boss parts) that are protruded perpendicularly from the outside surfaces 10*a* to receive a force to insert/remove the first connector housing 10 to/from a mating connector housing (the second connector housing 20) from the fitting lever 30 when the fitting lever 30 is pivoted. The first action receiving shafts 13 are equipped at roughly central positions in the widthwise direction (arrow Y2 direction of FIG. 1) of the first connector housing 10.

The shaft insertion cuts 14 are formed into a straight line along the fitting direction (arrow X2 direction of FIG. 1) of the connector housings. The shaft insertion cuts 14 are formed to extend toward the first action receiving shafts 13 from opening edges 11*b* of the outer sheath wall part 11. In other words, the first action receiving shafts 13 are formed on a straight line L1 which goes through the center of the first action receiving shafts 13 along the fitting direction of the connector housings, as shown in FIG. 2.

The inside dimension of the shaft insertion cuts 14 is so set that second action receiving shafts 21 of the second connector housing 20 to be described below can be inserted into the shaft insertion cuts 14.

As shown in FIGS. 1 and 3, the second connector housing 20 includes the second action receiving shafts 21 on a pair of outside surfaces 20*a*, respectively.

The second action receiving shafts 21 are protruded respectively from the outside surfaces 20*a* to confront the first action receiving shafts 13 in the fitting direction of the connector housings when the connector housings are aligned at a fitting start position. The central axis of the second action receiving shafts 21 is in parallel with that of the first action receiving shafts 13. The second action receiving shafts 21 and the first action receiving shafts 13 are cylindrical protrusions that have the same outer diameter.

Figure 13:
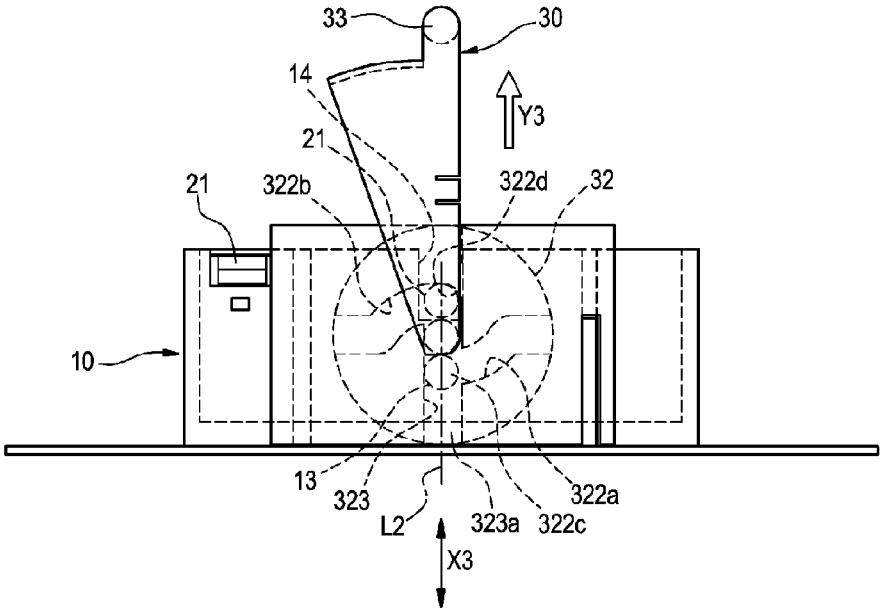
FIG. 13 is a side view of the lever connector shown in FIG. 12.

As shown in FIG. 13, when the connector housings are fitted with each other, the second action receiving shafts 21 are inserted into the shaft insertion cuts 14 and approach the first action receiving shafts 13.

The fitting lever 30 is a member by which an operating force to fit/detach the first connector housing 10 to/from the second connector housing 20 can be reduced, and is pivotably installed to the first connector housing 10.

The fitting lever 30 in the present embodiment includes a pair of housing coupling substrates 31, a pair of cam plates 32 and a lever body 33, as shown in FIG. 1.

The pair of housing coupling substrates 31 are arranged to be opposed to each other to sandwich the pair of outside surfaces 10*a* of the first connector housing 10. The housing coupling substrates 31 are equipped with guiding engaging parts 31*a* and pivoting fulcrum holes 31*b*, respectively, as shown in FIG. 4.

The guiding engaging parts 31*a* are stepped parts that extend along the fitting direction of the connector housings to regulate the movement in the arrow Y2 direction of FIG. 1 when engaged with the lever guiding parts 12 of the first connector housing 10. When the guiding engaging parts 31*a* are engaged with the lever guiding parts 12 the lever guiding parts 12 of the first connector housing 10, the pair of housing coupling substrates 31 are coupled to the outside surfaces 10*a* of the first connector housing 10 insertable/removable along the fitting direction of the connector housings.

The pivoting fulcrum holes 31*b* which the housing coupling substrates 31 are equipped with support the cam plates 32 pivotably, and are holes around which the cam plates 32 are pivoted.

The cam plates 32 are coupled to the central parts (pivoting fulcrum holes 31*b*) of the housing coupling substrates 31 to be pivotable in a predetermined pivoting angle range θ from a pivoting initial position N1 to the pivoting final position N2 shown in FIG. 7.

The pivoting initial position N1 is a position (direction) where the cam plates 32 are temporarily fixed to the housing coupling substrates 31 when the fitting lever 30 is installed to the first connector housing 10, as shown in FIG. 7. The pivoting final position N2 is a position (direction) where the cam plates 32 arrive after the cam plates 32 are pivoted a predetermined angle θ to fit and connect the connector housings as shown in FIG. 13 to be described.

In the present embodiment, the angle θ from the pivoting initial position N1 to the pivoting final position N2 is 90°.

As shown in FIG. 5, the lever body 33 is fixed to the cam plates 32 and is an operating member when the cam plates 32 are pivoted in the range from the above-mentioned pivoting initial position N1 to the pivoting final position N2. As shown in FIGS. 1 and 5, the lever body 33 includes a pair of arm parts 33*a* whose base ends are adhered to the central parts of the cam plates 32, and a pivoting part 33*b* which couples the distal ends of the pair of arm parts 33*a*. The pivoting part 33*b* is a part that applies an operating force to pivot the cam plates 32.

The pair of cam plates 32 are attached to the pair of housing coupling substrates 31 by a temporary fixing mechanism not shown to be temporarily fixed to the housing coupling substrates 31 at the above-mentioned pivoting initial position N1 or the pivoting final position N2.

As shown in FIG. 7, the cam plate 32 in the present embodiment includes a pair of initial engaging parts 321*a*, 321*b*, a pair of cam grooves 322*a*, 322*b* and an engagement opening groove 323.

The initial engaging parts 321*a*, 321*b* are grooves that extend along the fitting direction of the connector housings while the cam plates 32 are at the pivoting initial position N1, and are formed to open to the upper and lower outer edges opposed in the fitting direction of the connector housings.

Figure 8:
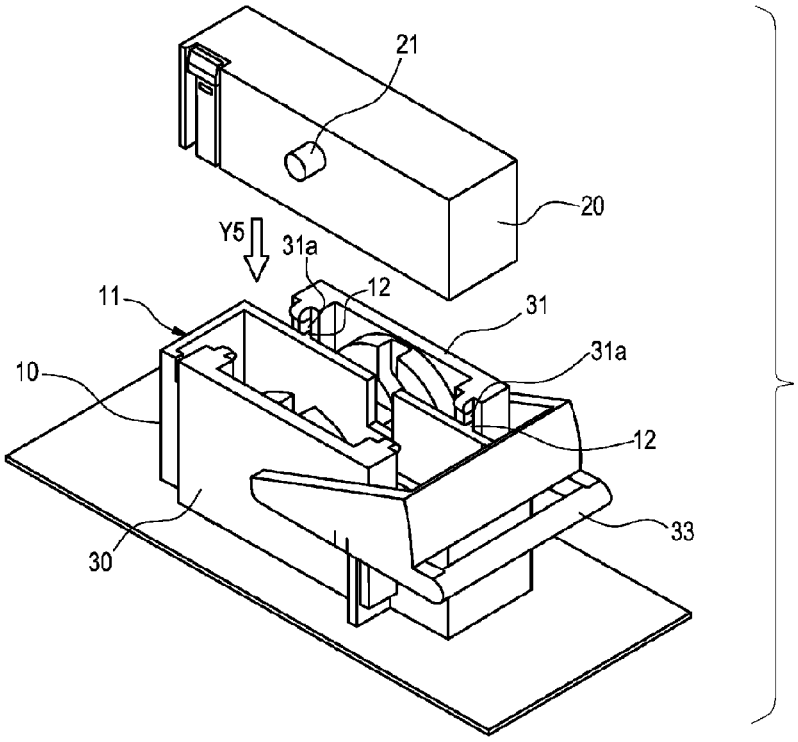
FIG. 8 is a perspective view which shows that the fitting lever is installed to the first connector housing in the lever connector of the embodiment shown in FIG. 1.
Figure 9:
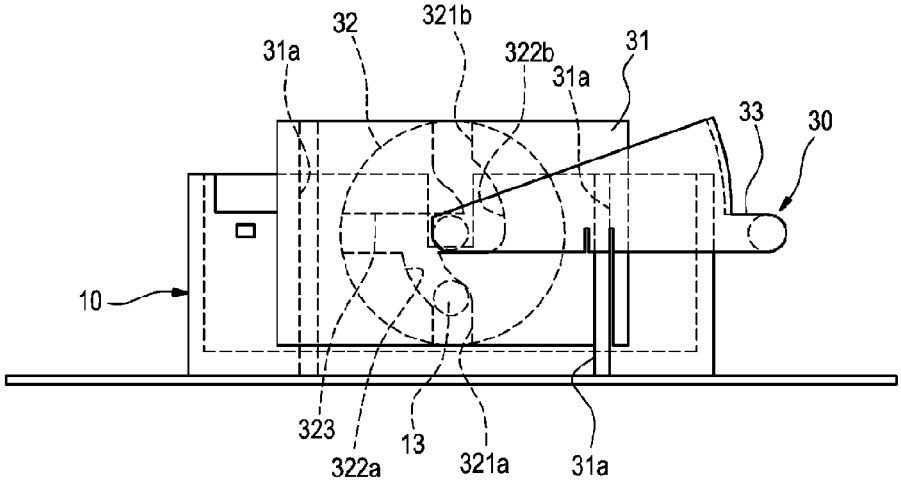
FIG. 9 is a side view of the first connector housing shown in FIG. 8.

The initial engaging parts 321*a* are grooves in which the first action receiving shafts 13 of the first connector housing 10 fit and engage when the fitting lever 30 is inserted and installed to the first connector housing 10 while the cam plates 32 are in the pivoting initial position N1 as shown in FIGS. 8 and 9 to be described later. The initial engaging parts 321*a* position the first action receiving shafts 13 to the initial ends of the cam grooves 322*a* to be described, when the fitting lever 30 has been installed to the first connector housing 10.

Figure 10:
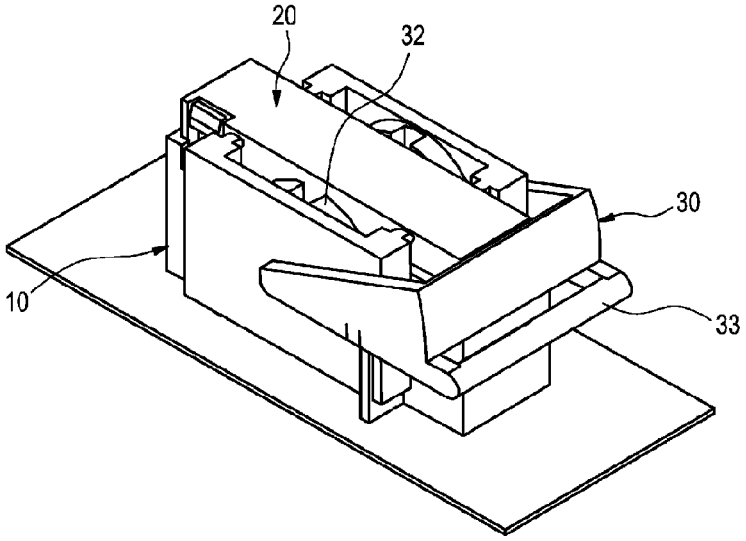
FIG. 10 is a perspective view which shows that the first connector housing and the second connector housing shown in FIG. 9 are aligned at a fitting start position.
Figure 11:
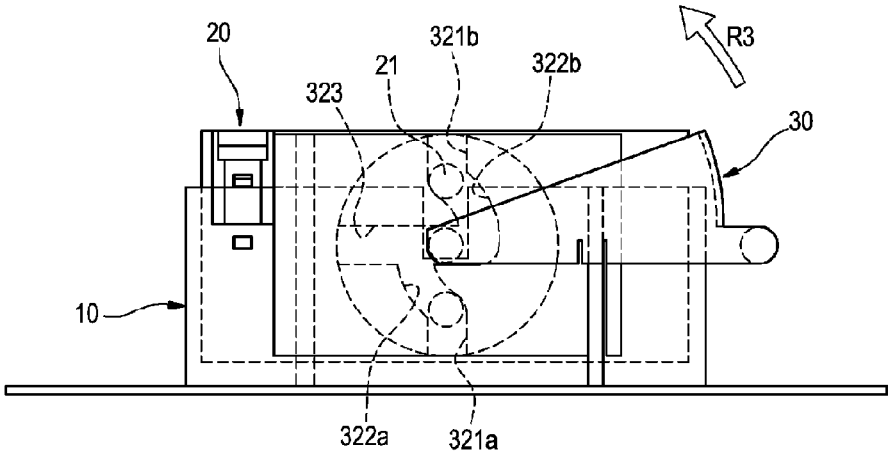
FIG. 11 is a side view of the lever connector shown in FIG. 10.

The initial engaging parts 321*b* are grooves in which the second action receiving shafts 21 of the second connector housing 20 fit and engage when the first connector housing 10 and the second connector housing 20 are aligned at the fitting start position while the cam plates 32 are in the pivoting initial position N1, as shown in FIGS. 10 and 11 to be described later. The initial engaging parts 321*b* position the second action receiving shafts 21 to the initial ends of the cam grooves 322*b* to be described, when the first connector housing 10 and the second connector housing 20 are aligned at the fitting start position.

The pair of cam grooves 322*a*, 322*b* are grooves that are formed to extend in the circumferential direction from the final ends of the initial engaging parts 321*a*, 321*b* to draw a smooth, curved orbit which gradually approach the pivoting center of the cam plates 32 from the pair of initial engaging parts 321*a*, 321*b*.

As shown in FIGS. 10 to 13, the cam grooves 322*a* are grooves to draw the first action receiving shafts 13 located at the final ends of the initial engaging parts 321*a* toward the pivoting center of the cam plates 32 with the pivoting of the cam plates 32.

As shown in FIGS. 10 to 13, the cam grooves 322*b* are grooves to draw the second action receiving shafts 21 located at the final ends of the initial engaging parts 321*b* toward the pivoting center of the cam plates 32 with the pivoting of the cam plates 32.

That is, the pair of cam groove 322*a*, 322*b* draw the action receiving shafts 13, 21 respectively at the pair of initial engaging parts 321*a*, 321*b* toward the pivoting center of the cam plates 32 with the pivoting of the cam plates 32.

The length of the pair of cam grooves 322*a*, 322*b* is so set that when the cam plates 32 arrived at the pivoting final position N2, as shown in FIG. 13, the final ends 322*c*, 322*d* of the pair of cam grooves 322*a*, 322*b*, where the action receiving shafts 13, 21 are located, confront in the fitting direction (direction along the arrow X3 of FIG. 13) of the connector housings.

The engagement opening groove 323 is a groove formed into a straight shape which passes through the final ends 322*c*, 322*d* of the pair of cam grooves 322*a*, 322*b* and opens at one end edge of the cam plate 32, as shown in FIG. 7. The engagement opening groove 323 is so formed that when the cam plates 32 is pivoted to the pivoting final position N2, an opening 323*a* is located at the inner side of the first connector housing 10 on a straight line L2 along the fitting direction of the connector housings, as shown in FIG. 13.

The engagement opening grooves 323 make the action receiving shafts 13, 21 to be detached to the outside the cam plates 32 when the cam plates 32 are linearly moved to the side opposite to the opening 323*a* (arrow Y3 direction of FIG. 13) along the fitting direction of the connector housings while the cam plates 32 are located at the pivoting final position as shown in FIG. 13.

Next, a method of fitting and connecting the connector housings with each other and a detaching method with the fitting lever 30 after the fitting and connecting in the lever connector 1 of the present embodiment are described based on FIGS. 1 and 8 to 14.

When the connector housings are to be fitted and connected, first, the fitting lever 30 is inserted to the first connector housing 10 along the fitting direction (arrow Y4 direction of FIG. 1) of the connector housings while the cam plates 32 are located at the pivoting initial position N1. Then, as shown in FIGS. 8 and 9, the housing coupling substrates 31 of the fitting lever 30 engage with the lever guiding parts 12 of the first connector housing 10, and the fitting lever 30 is installed to the first connector housing 10. At this time, the first action receiving shafts 13 of the first connector housing 10 engage with the initial engaging parts 321*a* which the cam plates 32 of the fitting lever 30 are equipped with, as shown in FIG. 9.

Then, while the fitting lever 30 is installed to the first connector housing 10, the second connector housing 20 is inserted in the direction as shown with the arrow Y5 of FIG.

8 into the first connector housing 10, and the first connector housing 10 and the second connector housing 20 are aligned at the fitting start position.

Then, as shown in FIGS. 10 and 11, the second action receiving shafts 21 of the second connector housing 20 also engage with the initial engaging parts 321*b* which the cam plates 32 of the fitting lever 30 are equipped with.

Figure 12:
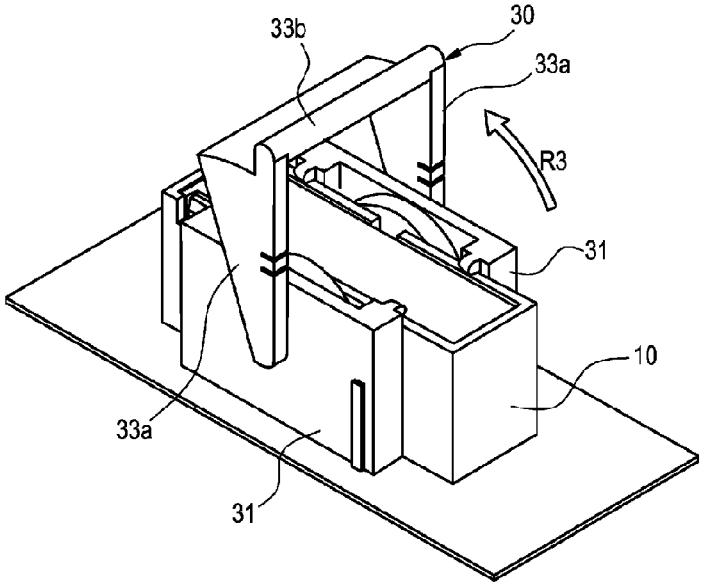
FIG. 12 is a perspective view which shows that the fitting lever is pivoted to the pivoting final position and the first connector housing and the second connector housing have been fitted and connected with each other.

Then, while the first connector housing 10 and the second connector housing 20 are aligned at the fitting start position, the lever body 33 of the fitting lever 30*a* is pivoted in the arrow R3 direction of FIGS. 11 and 12, to make the cam plates 32 in the fitting lever 30 pivot from the pivoting initial position N1 to the pivoting final position N2. With the pivoting of the cam plates 32 at this time, the pair of cam grooves 322*a*, 322*b* on the cam plates 32 draw the action receiving shafts 13, 21, which are respectively located at the initial engaging parts 321*a*, 321*b*, toward the pivoting center of the cam plates 32. Thus, when the action receiving shafts 13, 21 are drawn toward the pivoting center of the cam plates 32, respectively, the connector housings 10, 20 move in a direction to deepen the fitting with each other.

When the cam plates 32 arrive at the pivoting final position N2, as shown in FIG. 13, the action receiving shafts 13, 21 arrive at the final ends 322*c*, 322*d* of the pair of cam grooves 322*a*, 322*b*, and while the connector housings move toward the pivoting center of the cam plates 32 to the maximum, the connector housings have been fitted and connected with each other.

While the connector housings 10, 20 have been fitted and connected with each other with the pivoting operation of the fitting lever 30, as shown in FIG. 13, the action receiving shafts 13, 21, which are respectively located at the final ends 322*c*, 322*d* of the pair of cam grooves 322*a*, 322*b*, face the engagement opening grooves 323 that extend into a straight shape along the fitting direction of the connector housings 10, 20.

Figure 14:
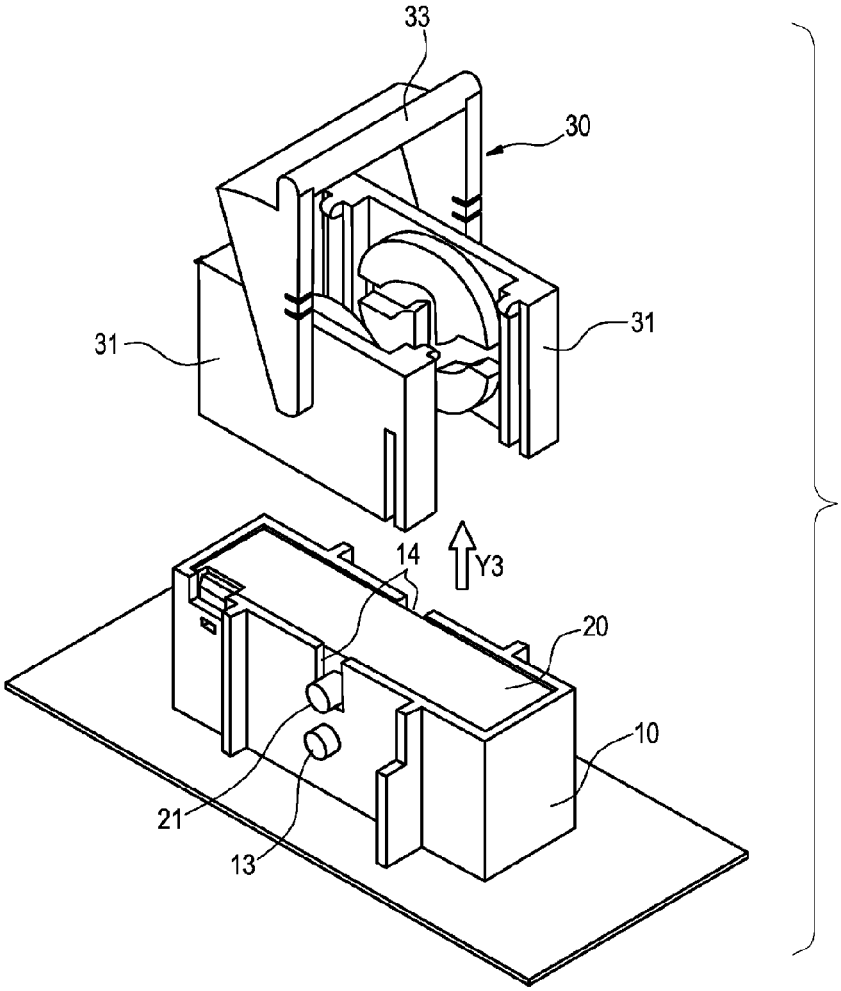
FIG. 14 is a perspective view which shows that after the first connector housing and the second connector housing have been fitted and connected with each other, the fitting lever is detached from the connector housings.
Figure 15:
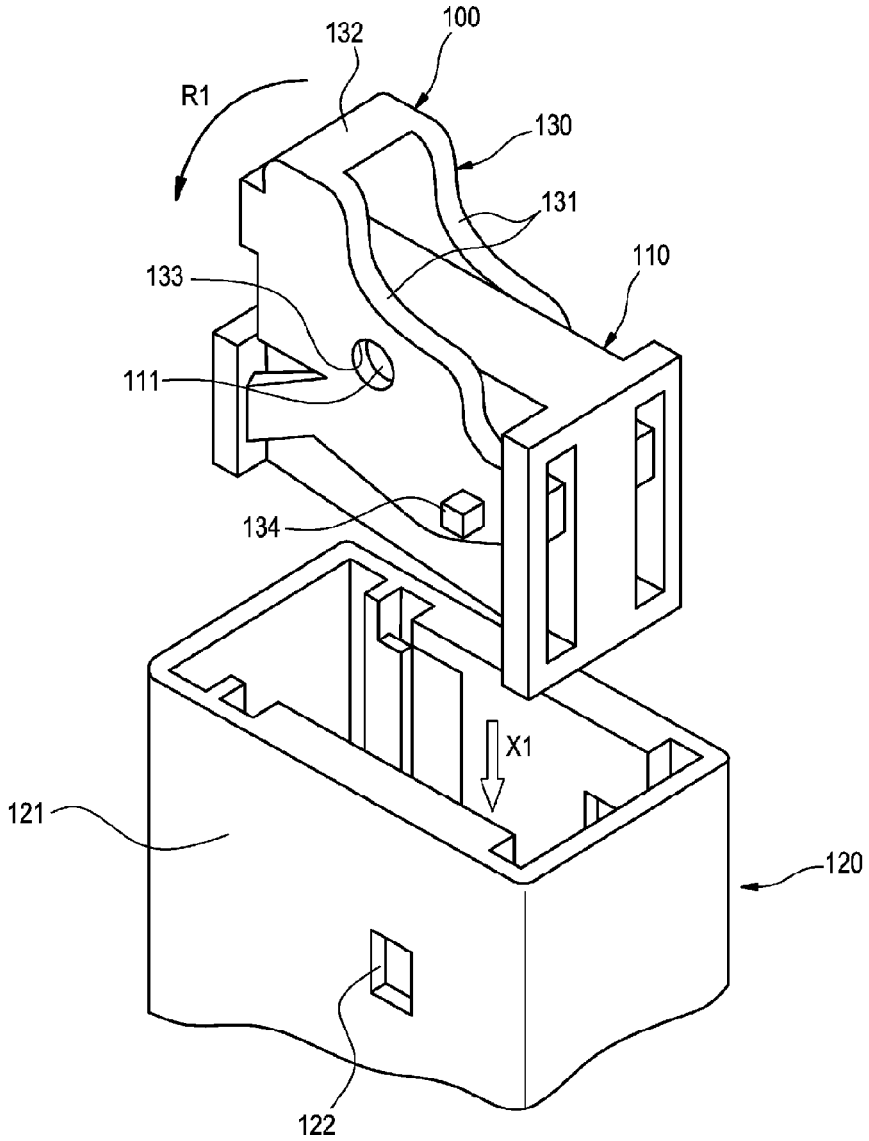
FIG. 15 RELATED ART
FIG. 15 is an exploded perspective view of a conventional lever connector.

Therefore, in this state, as shown with the arrows Y3 of FIGS. 13 and 14, because when the fitting lever 30 is pulled up in a direction reverse to the fitting direction of the connector housings 10, 20, the action receiving shafts 13, 21 respectively exit from the cam plates 32 through the engagement opening grooves 323, as shown in FIG. 14, the fitting lever 30 can be detached from the connector housings 10, 20.

When the fitting lever 30 is to be installed again to the connector housings 10, 20 which are fitted and connected with each other, the fitting lever 30 may be inserted and installed to the connector housings 10, 20 while the cam plates 32 in the fitting lever 30 are located at the pivoting final position N2 (refer to FIG. 7). If the connector housings 10, 20 are to be detached from each other, the fitting lever 30 may return the cam plates 32 to the pivoting initial position N1 (refer to FIG. 7) with the pivoting of the lever body 33. When the cam plates 32 are returned to the pivoting initial position N1, with the pivoting of the cam plates 32, the action receiving shafts 13, 21, which are respectively located at the final ends 322*c*, 322*d* of the cam grooves 322*a*, 322*b*, are moved in a direction away from the pivoting center of the cam plates 32 by the cam grooves 322*a*, 322*b*, and the connector housings 10, 20 are detached from each other.

That is, according to the above-described lever connector 1 of the embodiment, since after the connector housings 10, 20 have been fitted with each other, the fitting lever 30 is detached from the connector housings 10, 20, a reduction in weight can be realized in an use state of the connector.

The detached fitting lever 30 can be used in fitting other lever connectors. Therefore, the component set of a regular lever connector only includes the first connector housing 10 and the second connector housing 20 but does not include the fitting lever 30, so that the cost can be reduced by reducing the number of components.

For the above-described lever connector 1 of the embodiment, by drawing the connector housings 10, 20 toward the pivoting center of the cam plates 32 with the pair of cam grooves 322*a*, 322*b* which the cam plates 32 are provided with to sandwich the pivoting center, the cam plates 32 make the connector housings 10, 20 to be fitted with each other. Therefore, both sides that sandwich the pivoting center of the cam plates 32 are effectively used for the movement of the connector housings. Therefore, in comparison with that only one connector housing is moved in the fitting direction in one cam groove, the cam plates 32 can be downsized and the fitting lever 30 can be downsized by the reduction of the pivoting range of the cam plates 32.

For the lever connector 1 of the embodiment, in the middle of the fitting of the connector housings 10, 20, (that is, in the middle of the pivoting of the fitting lever 30), because the action receiving shafts 13, 21 of the connector housings 10, 20, which are engaged in the cam grooves 322*a*, 322*b* on the cam plates 32, are located away from the engagement opening grooves 323, the fitting lever 30 cannot be detached from the connector housings 10, 20. In other words, if the fitting lever 30 cannot be detached from the connector housings 10, 20, the connector housings 10, 20 are in the middle of fitting (half fitted state). Thus, it is possible to determine the fitted state of the connector housings 10, 20 with the operation of detaching the fitting lever 30, and it can be prevented that poor fitting of the connector housings with each other is overlooked.

The present invention is not limited to the above-described embodiments, and suitable modifications, improvements and the like can be made. Moreover, the materials, shapes, dimensions, numbers, installation places, and the like of the components in the above embodiment are arbitrarily set as far as the invention can be attained, and not particularly restricted.

Although the present invention is described in detail with reference to the specific embodiments, it is apparent that various modifications and amendments may be made by those skilled in the art without departing from the spirit and scope of the present invention.

This application is based on the Japanese patent application (patent application No. 2012-034172) filed on Feb. 20, 2012, contents of which are incorporated herein by reference.

The features of the lever connector according to the embodiment of the present invention described above are briefly, collectively listed in the following [1].

[1] A lever connector comprising a first connector housing (10), a second connector housing (20) which is fitted and connected with the first connector housing (10), and a fitting lever (30) which is pivotably installed to the first connector housing (10) as a lever member to reduce the operating force to fit/detach the first connector housing (10) with/from the second connector housing (20), wherein the first connector housing (10) includes an outer sheath wall part (11) into which the second connector housing (20) is inserted, lever guiding parts (12) which position the fitting lever (30) to be movable in the fitting direction of the connector housings, first action receiving shafts (13) which are protruded outward from a pair of outside surfaces (10*a*), respectively, and shaft insertion cuts (14) which are formed by cutting a pair of opposed outside walls (11*a*) of the outer sheath wall part (11) to extend into a straight shape along the fitting direction of the connector housings toward the first action receiving shafts (13) from opening edges (11*b*) of the outer sheath wall part (11), the second connector housing (20) includes second action receiving shafts (21) which are protruded from the outside surfaces (20*a*) of the second connector housing (20) so that when the connector housings are aligned at a fitting start position, the central axis of the second action receiving shafts (21) is in parallel with that of the first action receiving shafts (13) and the second action receiving shafts (21) confront the first action receiving shafts (13) in the fitting direction of the connector housings, and which are inserted through the shaft insertion cuts (14) to approach the first action receiving shafts (13) when the connector housings are to be fitted, the fitting lever (30) includes a pair of housing coupling substrates (31) which are engaged with the lever guiding parts (12) to be coupled to the outside surfaces (10*a*) of the first connector housing to be insertable/detachable in the fitting direction of the connector housings, a pair of cam plates (32) which are coupled to the central parts of the housing coupling substrates (31) to be pivotable in a predetermined pivoting angle range from a pivoting initial position to a pivoting final position, and a lever body (33) which is fixed to the cam plates (32) and is an operating part when the cam plates (32) are pivoted from the pivoting initial position to the pivoting final position, and the cam plates (32) include a pair of initial engaging parts (321*a*, 321*b*) which are formed to open to outer edges that are opposed in the fitting direction of the connector housings while the cam plates are at the pivoting initial position, and which engage the first action receiving shafts (13) and the second action receiving shafts (21) when the first connector housing (10) and the second connector housing (20) are aligned at the fitting start position, a pair cam grooves (322*a*, 322*b*) which are formed to extend along the circumferential direction from the pair of initial engaging parts (321*a*, 321*b*) and whose final ends, where the action receiving shafts (13, 21) are respectively located when the cam plates (32) arrive at the pivoting final position while the action receiving shafts (13, 21) in the pair of initial engaging parts (321*a*, 321*b*) are respectively drawn toward the pivoting center of the cam plates (32) with the pivoting of the cam plates (32), confront in the fitting direction of the connector housings, and engagement opening grooves (323) which are formed into straight shapes that pass through the final ends of the pair of cam grooves (322*a*, 322*b*) and open at one end edges of the cam plates (32), and which make it possible to detach the action receiving shafts (13, 21) to the outside of the cam plates (32) by straightly move the cam plates (32) to a side reverse to the openings along the fitting direction of the connector housings while the cam plates (32) are located at the pivoting final position.

INDUSTRIAL APPLICABILITY

According to the lever connector of the present invention, after the connector housings have been fitted with each other, the fitting lever is detached from the connector housings so that a reduction in weight can be realized in an use state of the connector.

The present invention which has the above effect is useful in the field of lever connector.

REFERENCE SIGNS LIST

1 lever connector
10 first connector housing
10*a* outside surface
11 outer sheath wall part
11*a* outer side wall
12 lever guiding part
13 first action receiving shaft
14 shaft insertion cut
20 second connector housing
21 second action receiving shaft
30 fitting lever
31 housing coupling substrate
32 cam plate
33 lever body
321*a*, 321*b* initial engaging parts
322*c*, 322*d* groove final ends
322*a*, 322*b* cam groove
323 engagement opening groove
N1 pivoting initial position
N2 pivoting final position

The invention claimed is:

1. A lever connector comprising:

a first connector housing;

a second connector housing which is fitted and connected with the first connector housing in a fitting direction, the second connector housing defining a pair of outside surfaces; and a fitting lever which is pivotably installed to the first connector housing as a lever member to reduce the operating force to fit and detach the first connector housing with and from the second connector housing, wherein the first connector housing includes:

an outer sheath wall part into which the second connector housing is inserted;

lever guiding parts which position the fitting lever to be movable in the fitting direction of the connector housings;

first action receiving shafts which are protruded outward from a pair of outside surfaces of the first connector housing, respectively; and shaft insertion cuts which are formed by cutting a pair of opposed outside walls of the outer sheath wall part to extend into a straight shape along the fitting direction of the connector housings toward the first action receiving shafts from opening edges of the outer sheath wall part, the second connector housing includes second action receiving shafts which define a central axis and are protruded from the pair of outside surfaces of the second connector housing so that when the connector housings are aligned at a fitting start position, the central axis of the second action receiving shafts is in parallel with that of the first action receiving shafts and the second action receiving shafts confront the first action receiving shafts in the fitting direction of the connector housings, and which are inserted through the shaft insertion cuts to approach the first action receiving shafts when the connector housings are to be fitted, the fitting lever includes:

a pair of housing coupling substrates which are engaged with the lever guiding parts to be coupled to the outside surfaces of the first connector housing to be insertable and detachable in the fitting direction of the connector housings, the pair of housing coupling substrates defining central parts;

a pair of cam plates which are coupled to the central parts of the housing coupling substrates to be pivotable in a predetermined pivoting angle range from a pivoting initial position to a pivoting final position in a circumferential direction; and a lever body which is fixed to the cam plates and is an operating part when the cam plates are pivoted from the pivoting initial position to the pivoting final position, and the cam plates include:

a pair of initial engaging parts which are formed to open to outer edges that are opposed in the fitting direction of the connector housings while the cam plates are at the pivoting initial position, and which engage the first action receiving shafts and the second action receiving shafts when the first connector housing and the second connector housing are aligned at the fitting start position;

a pair of cam grooves which are formed to extend along the circumferential direction from the pair of initial engaging parts to final ends that are configured to confront the first and second action receiving shafts of the connector housings when moved along the fitting direction to the pivoting final position, the first and second action receiving shafts in the pair of initial engaging parts being drawn toward the pivoting center of the cam plates by operation of the pivoting of the cam plates, such that the final ends of the pair of cam grooves are disposed where the first and second action receiving shafts are respectively located when the cam plates arrive at the pivoting final position; and engagement opening grooves which are formed into straight shapes that pass through the final ends of the pair of cam grooves and define an opening at an edge of each of the cam plates, the engagement opening grooves facilitating release of the action receiving shafts to the outside of the cam plates by allowing the cam plates to linearly move away from an interior side surface of the first connector housing that faces the openings of the cam plates, the linear movement of the cam plates being along the fitting direction of the connector housings while the cam plates are located at the pivoting final position.

* * * * *